US008347935B2

(12) United States Patent
Svirsky et al.

(10) Patent No.: US 8,347,935 B2
(45) Date of Patent: Jan. 8, 2013

(54) RIGID RETRACTABLE PATIO OR WINDOW AWNING AND OPERATING MECHANISMS THEREFOR

(76) Inventors: Alexander Svirsky, Aurora, CO (US); Vladimir Svirsky, Aurora, CO (US)

( * ) Notice: Subject to any disclaimer, the term of this patent is extended or adjusted under 35 U.S.C. 154(b) by 237 days.

(21) Appl. No.: 12/705,567

(22) Filed: Feb. 12, 2010

(65) Prior Publication Data

US 2011/0198041 A1 Aug. 18, 2011

(51) Int. Cl.
*E04F 10/10* (2006.01)

(52) U.S. Cl. ..... 160/61; 160/62; 160/352; 160/82; 160/74; 160/75

(58) Field of Classification Search ..... 160/61, 160/62, 81, 82, 74, 75, 370.22, 218, 265
See application file for complete search history.

(56) References Cited

U.S. PATENT DOCUMENTS

| | | | | | |
|---|---|---|---|---|---|
| 370,259 | A * | 9/1887 | Horbaczewski | 160/62 |
| 427,287 | A * | 5/1890 | Wood et al. | 160/62 |
| 1,785,809 | A * | 12/1930 | Davis | 160/10 |
| 2,505,416 | A * | 4/1950 | Mahaffey | 74/89.37 |
| 2,531,797 | A * | 11/1950 | Wellman | 160/222 |
| 2,549,302 | A * | 4/1951 | Ferfort | 160/62 |
| 2,563,547 | A * | 8/1951 | Paddock et al. | 160/62 |
| 2,564,641 | A * | 8/1951 | Drake | 160/62 |
| 2,581,827 | A * | 1/1952 | Zveibil | 160/62 |
| 2,699,823 | A * | 1/1955 | Zveibil | 160/62 |
| 2,699,824 | A * | 1/1955 | Zveibil | 160/62 |
| 2,824,607 | A * | 2/1958 | Sosower | 160/62 |
| 2,967,567 | A * | 1/1961 | Heckerman | 160/62 |
| 3,557,457 | A * | 1/1971 | Rashbaum | 33/1 R |
| 4,898,044 | A * | 2/1990 | Galloway | 74/424.6 |
| 5,128,688 | A * | 7/1992 | West | 343/766 |
| 5,996,666 | A * | 12/1999 | Denina | 160/62 |
| 6,457,508 | B1 * | 10/2002 | Tomita | 160/67 |

* cited by examiner

*Primary Examiner* — Katherine W Mitchell
*Assistant Examiner* — Jaime F Cardenas-Garcia
(74) *Attorney, Agent, or Firm* — Alexander R. Svirsky

(57) ABSTRACT

A rigid retractable patio or window awning includes a number of rigid panels disposed in a tiered relationship with each other. Each lower panel is slidably connected with its respective upper panel via a set of slides. The top panel remains stationary. An awning operating mechanism includes arms connected via swivel joints with the bottom panel. Each arm also is connected via a threaded nut with a drive screw. The awning is extended by rotating the drive screw, which causes the nuts to travel along the drive screw causing the arms to push the bottom panel outwardly and the bottom panel to pull along any intermediate panels. The awning is retracted by rotating the drive screw in the opposite direction.

3 Claims, 9 Drawing Sheets

RIGID RETRACTABLE PATIO OR WINDOW AWNING AND OPERATING MECHANISMS THEREFOR

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention relates to awnings and more particularly to retractable patio or window awnings.

Retractable patio, deck and porch awnings have been known for many years and have gained great popularity. They are used to create shade over decks and patios and also may provide protection from light rain. The retractability feature allows the user to retract the awning when shade is not desired or during severe weather conditions.

In addition, retractable patio awnings provide energy savings by shading doors and patios from direct sunlight and thereby reducing gain of solar heat by the associated building. By lowering temperature inside the building during the air conditioning season, patio awnings create savings in cooling energy. The ability to retract the awning during the heating season allows the user to prevent the blockage of desirable passive gain of solar heat, thereby achieving the maximum energy savings.

Most popular known retractable patio awnings are represented by the structure described in U.S. Pat. No. 6,957,679 to Powell. They include a frame, roll bar, front bar, extendable lateral arms attached to the frame and the front bar, and an awning sheet, usually made of fabric, wound around the roll bar and connected to the front bar. Such awning is extended by rotating the roll bar to unwind the fabric, which allows the spring-loaded extendable lateral arms to push the front bar outwardly from the roll bar. To retract the awning, the roll bar is rotated in the opposite direction.

Such known retractable patio awnings, where the cover is made of fabric, are not sufficiently durable, as they require periodic replacement of the fabric. Even before the fabric needs replacement, it fades making the awning appearance less attractive. Such awnings also require periodic fabric cleaning to prevent accumulation of dust and dirt that promotes growth of microorganisms, such as mold. Fabric also is prone to sagging and resulting accumulation of water when the awning remains in the extended position during rain.

Also known are rigid adjustable or retractable patio awnings. A slidably adjustable rigid awning is disclosed in U.S. Pat. No. 5,873,202 to Parks. In such an awning, slated louver sets, one of which is movable, are arranged one above the other, and the adjustment of the amount of pass-through sunlight is achieved by sliding the movable louver set relative to the stationary set. Such awning may not be fully retracted and always creates shade, even when shade is not necessary or desired. A rigid retractable awning in the form of adjustable overhang panel is disclosed in U.S. Pat. No. 4,608,788 to Porter et al. It describes a rigid panel positioned under a building eave that can be extended in the summer and retracted in the winter. Such awning may be extended and retracted by only a very short distance, which is limited by the projection of the building eave or any extension thereof. Upon awning retraction, any eave extension remains in place creating a condition that may not be visually appealing. U.S. Pat. No. 2,094,801 to Mass describes an awning in the form of a set of stackable rigid panels supported by inclined rails, in turn supported by upright posts. The awning is operated by moving the panels up and down the inclined rails using a rope and pulley mechanism. Such operating mechanism is cumbersome and prone to malfunction. In addition, even when the awning is retracted, the inclined rails, support posts and operating mechanism all remain exposed to weather elements and create undesirable obstructions in the area covered by such awning.

BRIEF SUMMARY OF THE INVENTION

The present invention provides a rigid retractable patio awning that includes a plurality of rigid panels disposed above the area to be shaded in a tiered relationship with each other. Each lower panel is slidably connected with its respective upper panel via a set of slides. The top panel remains stationary. When the awning is being extended, each lower panel slides relative to its respective upper panel outwardly from the top stationary panel. When the awning is being retracted, each lower panel slides relative to its respective upper panel toward the top stationary panel. To enable the awning's extension and retraction, the bottom panel is connected via swivel joints with two or more arms.

An object of the present invention is to provide a rigid retractable patio awning that may be fully retracted when shade is not required.

Another object of the present invention is to provide a rigid retractable patio awning that may be extended and retracted by a sufficient distance to cover an average-sized patio.

A further object of the present invention is to provide a rigid retractable patio awning that does not require any support structures that must remain in place when the awning is in a retracted position.

A further object of the present invention is to provide a rigid retractable patio awning that may be operated manually or by power.

A further object of the present invention is to provide sufficiently simple and reliable operating mechanisms for rigid retractable patio awnings.

BRIEF DESCRIPTION OF THE DRAWINGS

Other advantages of the present invention will be apparent to those skilled in the art from the following description of its embodiments with reference to the accompanying drawings wherein.

DETAILED DESCRIPTION OF THE INVENTION

Figure 1:
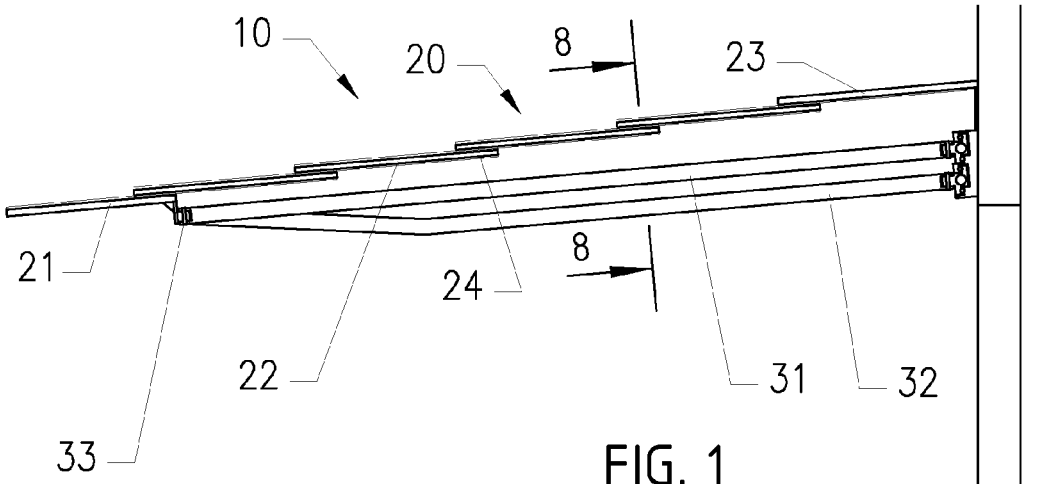
FIG. 1 is a side view of a rigid retractable patio awning constructed in accordance with the present invention in the fully extended position.

Referring to the drawings, in particular to FIG. 1, where a rigid retractable patio awning constructed in accordance with the present invention is shown in the fully extended position and is generally designated by a numeral 10, the awning includes a plurality of rigid panels 20 including a bottom panel 21, a number of intermediate panels 22 and a top panel 23. The panels 20 are disposed in a tiered relationship with each other, and each lower panel is slidably connected with its respective upper panel via a set of slides 24. The top panel 23 remains stationary.

Figure 6:
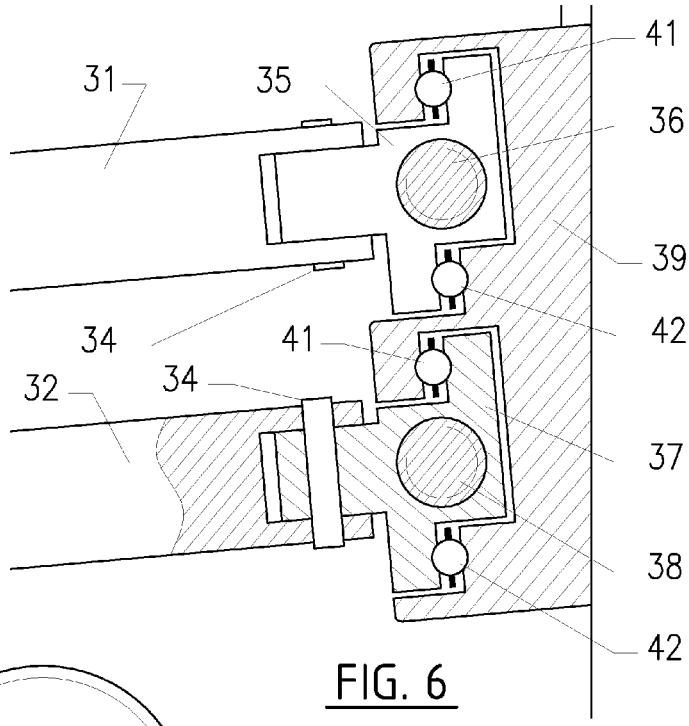
FIG. 6 is an enlarged sectional view of the awning operating mechanism in the extended position, and the wall mounting area.
Figure 7:
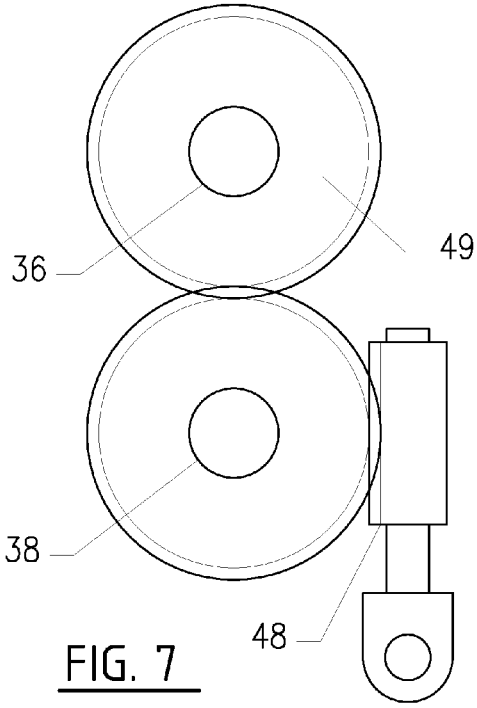
FIG. 7 is an enlarged front view of the awning operating mechanism transmission.
Figure 8:
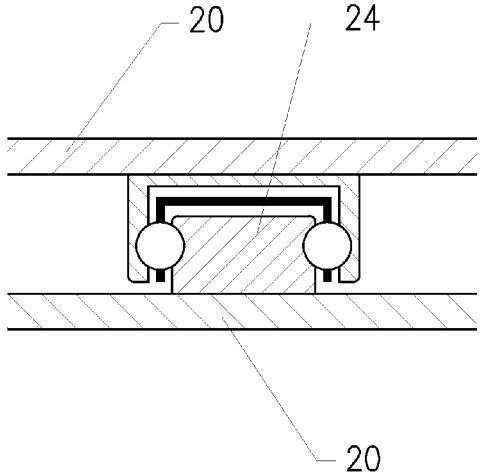
FIG. 8 is a sectional view of a panel slide.

The first embodiment of the present invention shown in FIGS. 1-8 employs an operating mechanism that includes an upper arm 31 and a lower arm 32 connected via swivel joints 33 with the bottom panel 21. The opposite end of the upper arm 31 is movably connected via a swivel joint 34 with a threaded nut 35 engaged with an upper drive screw 36. The opposite end of the lower arm 32 is movably connected via a swivel joint 34 with a threaded nut 37 engaged with a lower drive screw 38. Nuts 35 and 37 are slidably connected with a mounting bar 39 via a linear bearing consisting of an upper bearing 41 and a lower bearing 42. The mounting bar 39 and bearings 41 and 42 shown in FIG. 6 are omitted from FIGS. 3, 4 and 5 for clarity.

Figure 2:
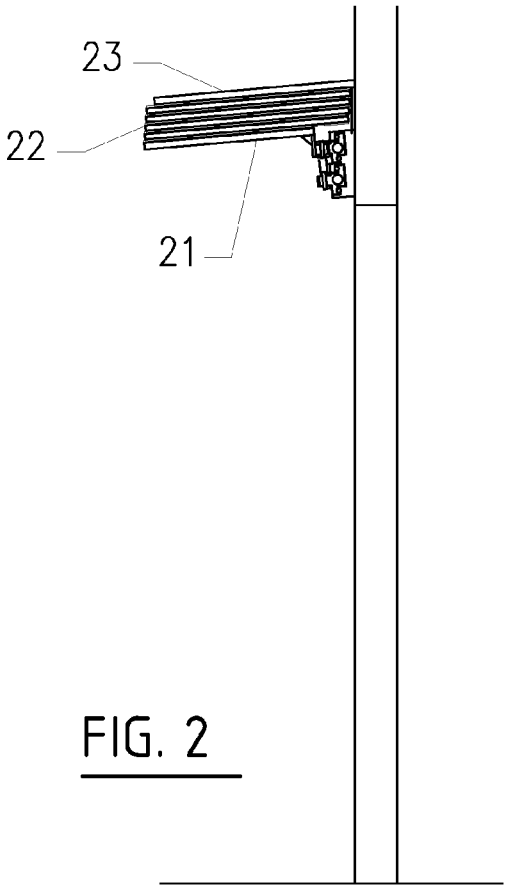
FIG. 2 is a side view of a rigid retractable patio awning of the present invention in the fully retracted position.
Figure 3:
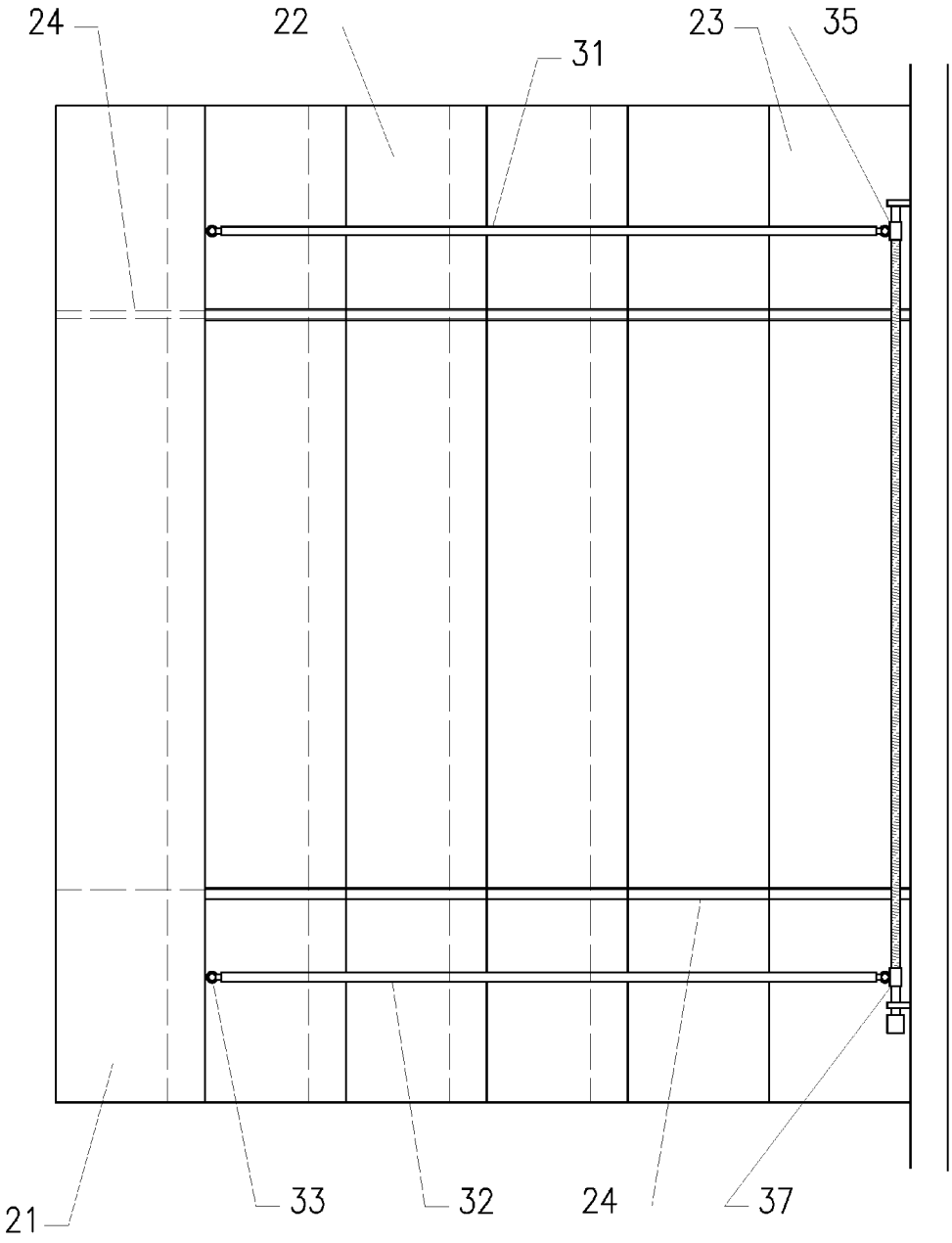
FIG. 3 is a bottom view of a rigid retractable patio awning of the present invention in the fully extended position.
Figure 4:
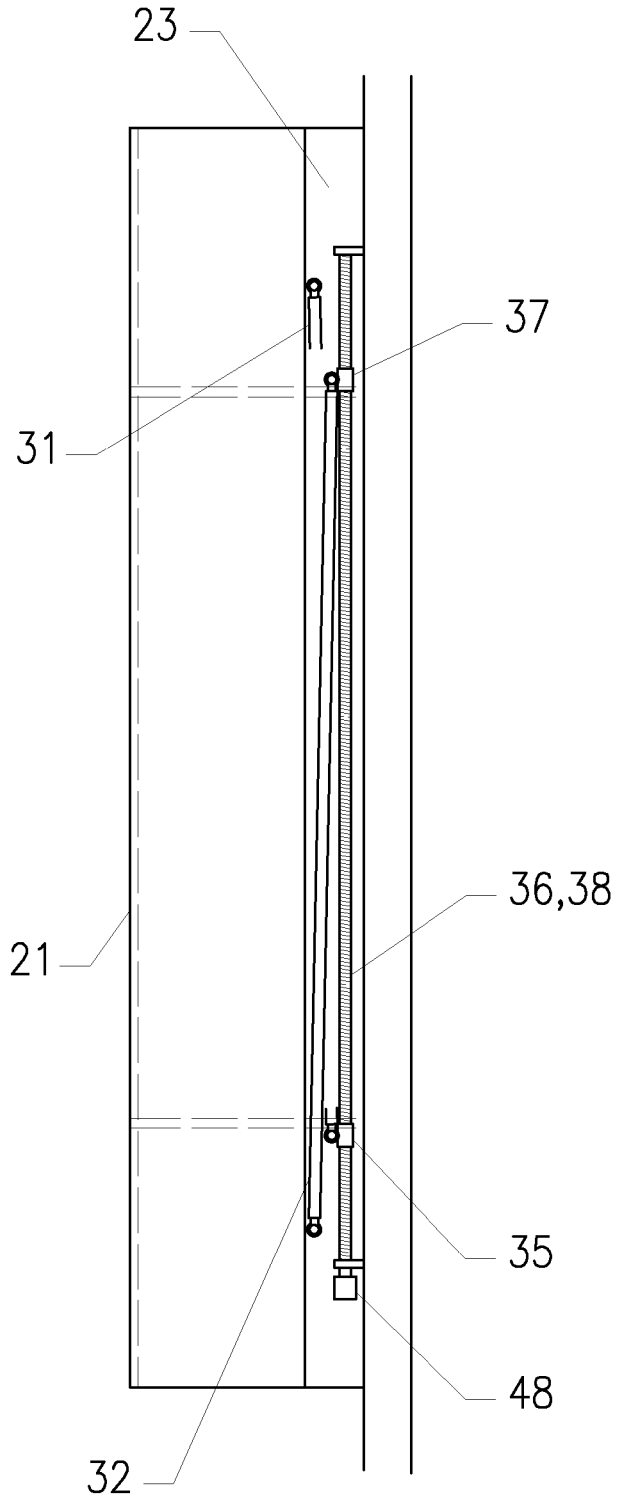
FIG. 4 is a bottom view of a rigid retractable patio awning of the present invention in the fully retracted position.
Figure 5:
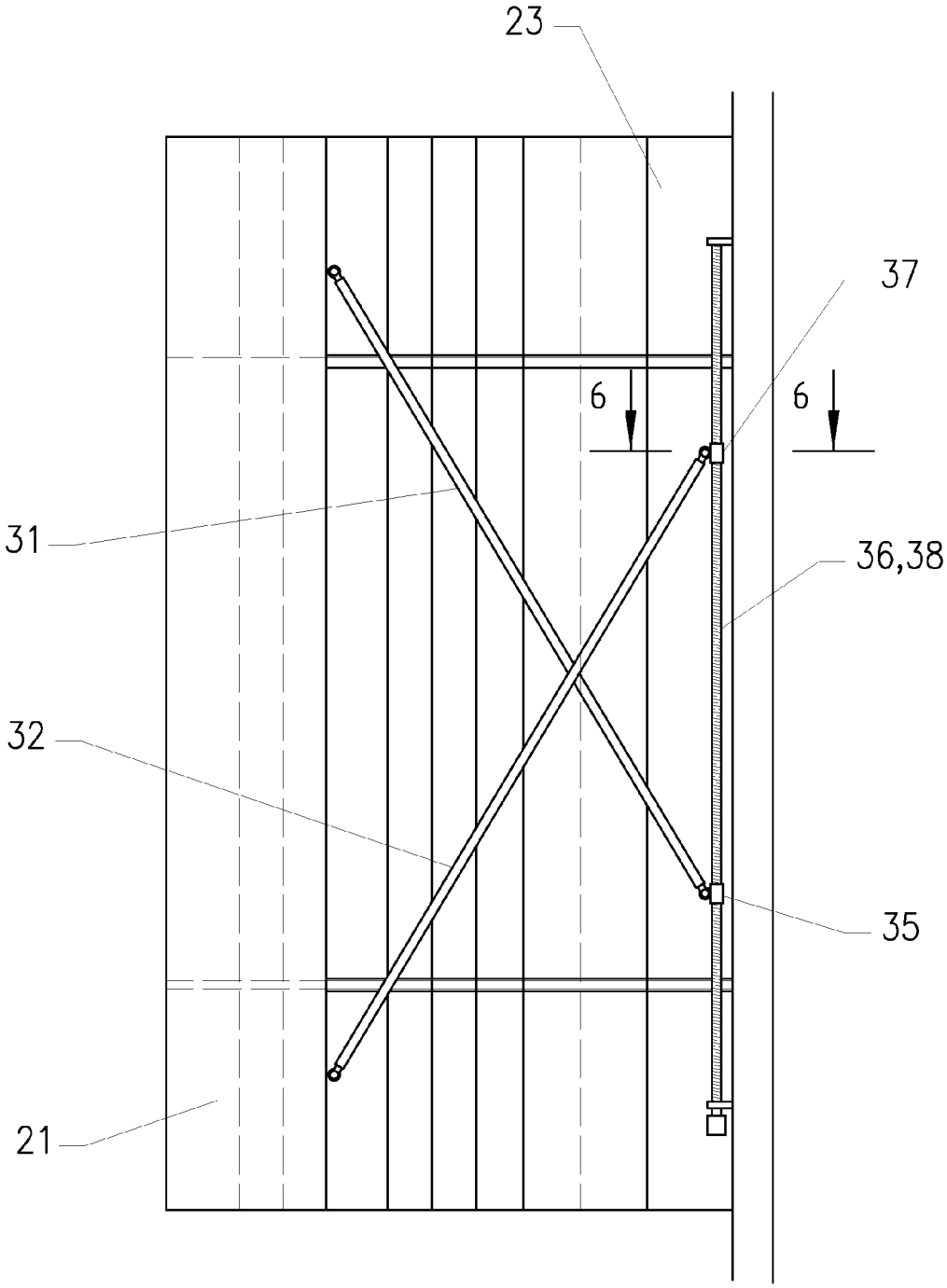
FIG. 5 is a bottom view of a rigid retractable patio awning of the present invention in a partially extended position.

To extend the awning from its retracted position shown in FIGS. 2 and 4 to its extended position shown in FIGS. 1 and 3, the drive screws 36 and 38 are rotated so that the nuts 35 and 37 travel toward each other, which causes the arms 31 and 32 to push the bottom panel 21 outwardly and the bottom panel 21 to pull along the intermediate panels 22. The nuts 35 and 37 continue traveling in the same direction until they reach their end positions shown in FIG. 3. The nuts 35 and 37 are slidably connected with the mounting bar 39 via linear bearings along the entire length of the nut travel from the initial position shown in FIGS. 2 and 4 to the end position shown in FIGS. 1 and 3. To retract the awning, the drive screws 36 and 38 are rotated in the opposite direction causing the arms 31 and 32 to pull panels 21 and 22 back toward the top panel 23. The use of an upper arm and a lower arm operated, respectively, by an upper drive screw and a lower drive screw allows the threaded nuts 37 and 38 to travel essentially the entire length of the mounting bar 39, which provides for the wide range of motion of the awning between its retracted and extended positions approximately equal to the length of the mounting bar. Rotation of the drive screws 36 and 38 may be accomplished manually via gear transmissions 48 and 49 or by an electric motor.

Figure 9:
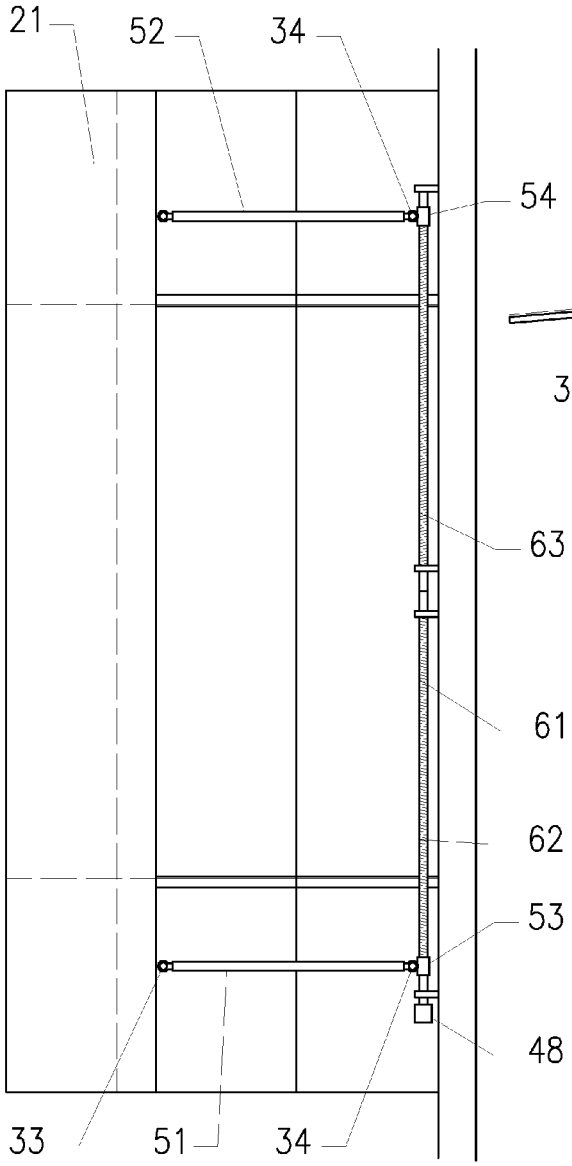
FIG. 9 is a bottom view of another embodiment of a rigid retractable awning of the present invention in the fully extended position.
Figure 10:
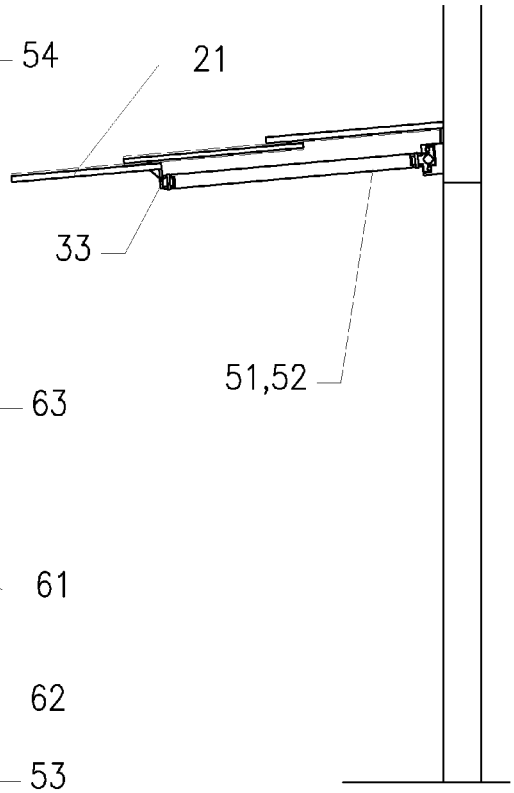
FIG. 10 is a side view of the awning embodiment shown in FIG. 9.
Figure 11:
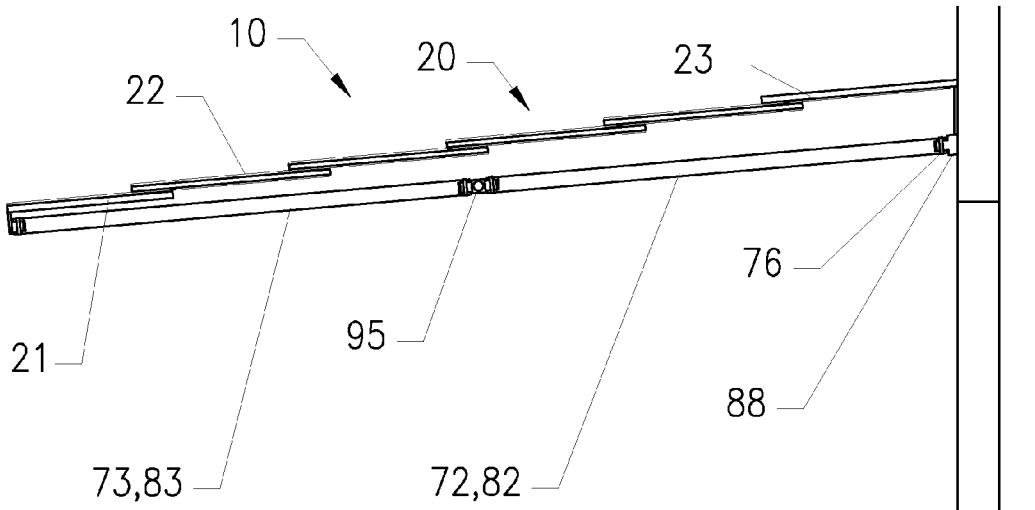
FIG. 11 is a side view of yet another embodiment of a rigid retractable patio awning of the present invention in the extended position showing a different type of operating mechanism.

A second embodiment of the present invention is shown in FIGS. 9 and 10 and is suitable for a situation where a shorter awning projection distance is sufficient. Such situation may be present in wide and relatively shallow patios or when the awning is used over windows. In this embodiment the operating mechanism includes a left arm 51 and a right arm 52 connected via swivel joints 33 with the bottom panel 21. A drive screw 61 includes a left section 62 and a right section 63 threaded in opposite directions. The left arm 51 and the right arm 52 are connected via swivel joints 34 with threaded nuts 53 and 54 engaged, respectively, with the left drive screw section 62 and the right drive screw section 63.

To retract the awning in its second embodiment shown in FIGS. 9 and 10, the drive screw 61 is rotated so that the nuts 53 and 54 travel toward each other along the drive screw 61, which causes arms 51 and 52 to pull the bottom panel 21 and any intermediate panels. To extend the awning, the drive screw 61 is rotated in the opposite direction.

A third embodiment of the present invention shown in FIGS. 11, 12, 13 and 14 employs an operating mechanism that includes a left arm 71 and a right arm 81. The arms 71 and 81 include proximate sections 72 and 82 respectively and distant sections 73 and 83 respectively. Arm sections 72 and 73 are connected via swivel joints 74 with a threaded nut 75. Arm sections 82 and 83 are connected via swivel joints 84 with a threaded nut 85. The proximate sections 72 and 82 are connected via swivel joints 76 with a mounting bar 88. The distant sections 73 and 83 are connected via swivel joints 77 with a bottom panel 21. The nuts 75 and 85 are engaged with a drive screw 95 that includes a left section 96 and a right section 97. The drive screw sections 96 and 97 are threaded in opposite directions.

Figure 12:
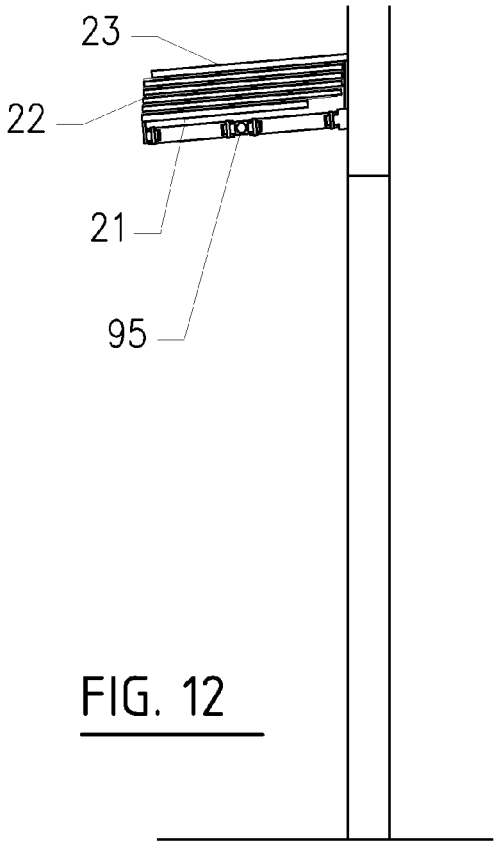
FIG. 12 is a side view of the awning embodiment shown in FIG. 11 in the retracted position.
Figure 13:
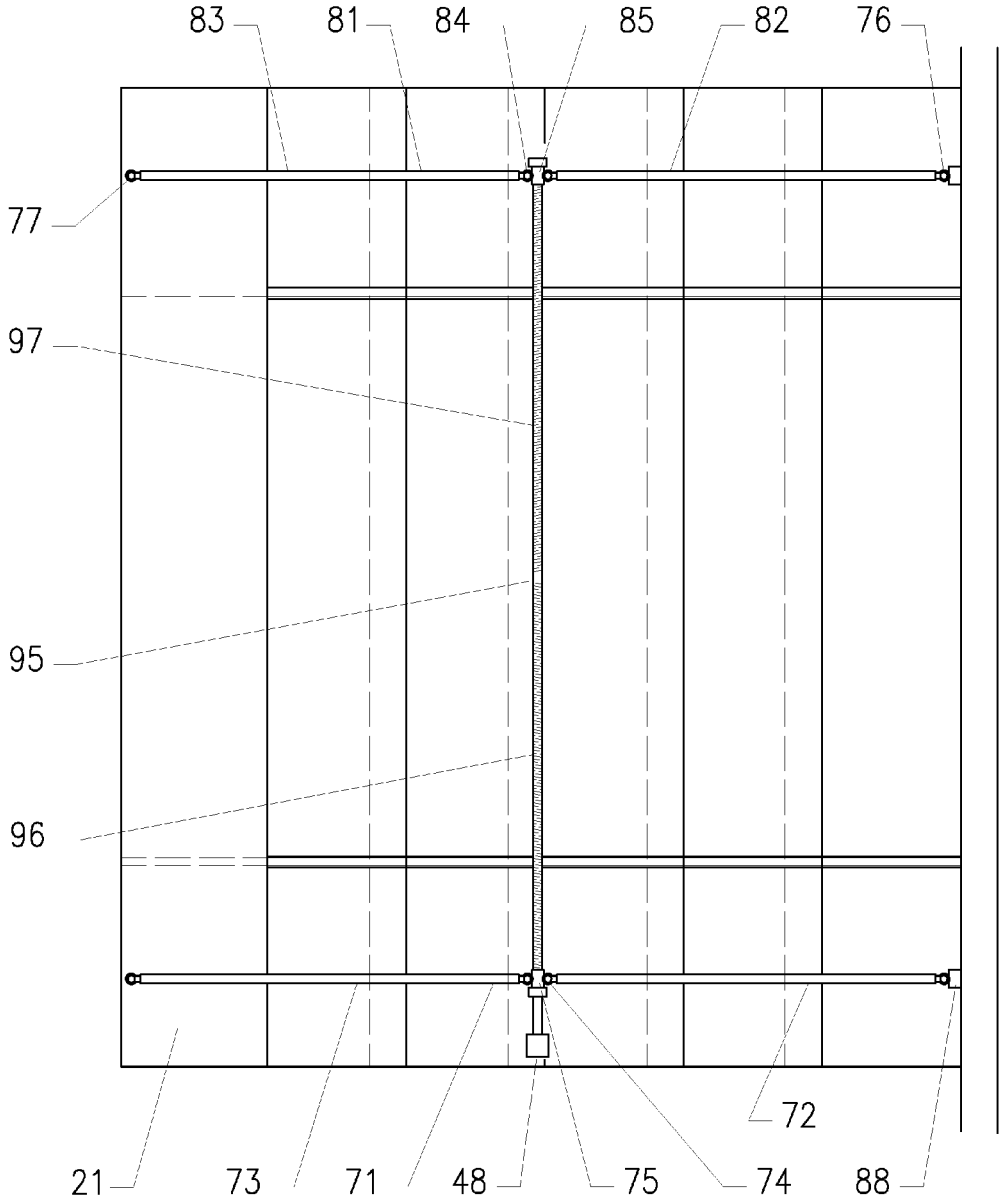
FIG. 13 is a bottom view of the awning embodiment shown in FIG. 11 in the extended position.
Figure 14:
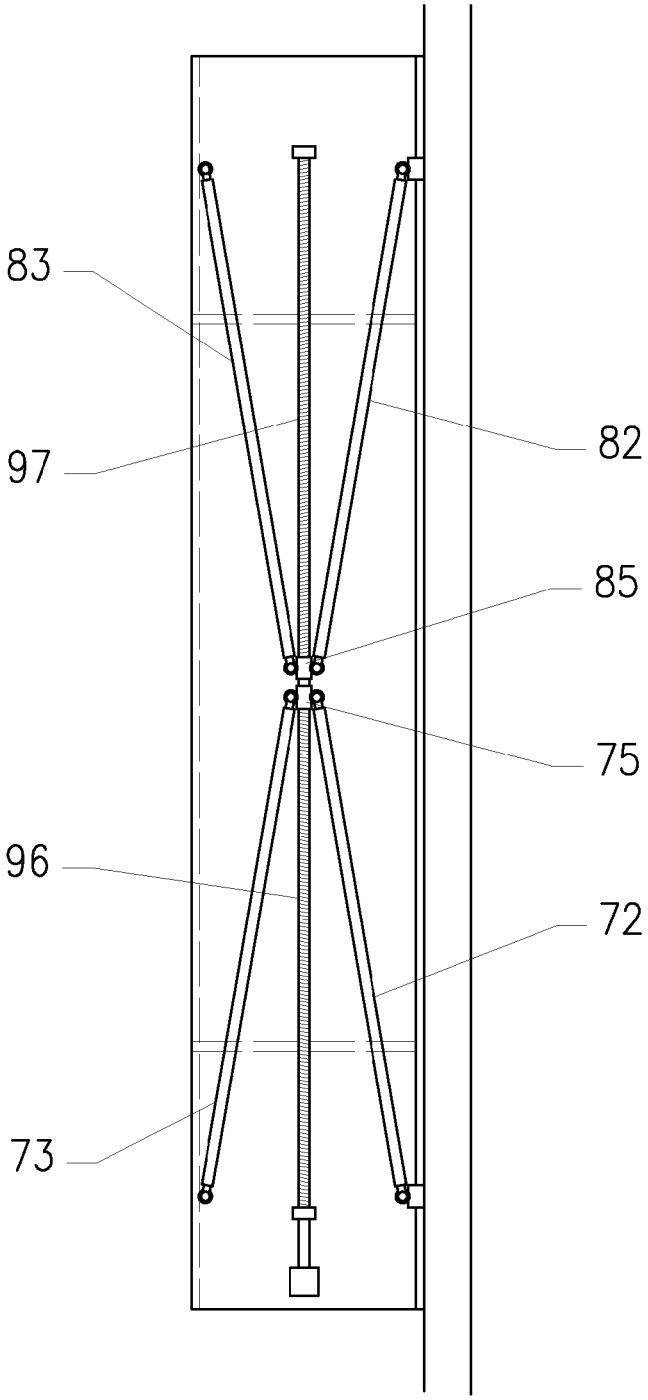
FIG. 14 is a bottom view of the awning embodiment shown in FIGS. 11, 12 and 13 in the retracted position.

To extend the awning, as shown in its retracted position in FIGS. 12 and 14, the drive screw 95 is rotated so that the nuts 75 and 85 travel in opposite directions toward the ends of the drive screw 95. To retract the awning, the drive screw 95 is rotated in the opposite direction.

It will be understood that this invention is not restricted to the embodiments described and illustrated above. The drive screws 36, 38, 61 and 95 may be rotated manually or by an electric motor, which may be operated from a wall switch or remote control. The pair of linear bearings 41 and 42 shown in FIG. 6 may be positioned as a left and right bearing, to reduce the vertical dimension, or may be even replaced with a single bearing. The linear bearings may be plain or rolling bearings that, in turn, may be ball or roller bearings. In the third embodiment shown in FIGS. 11-14, an electric motor may be installed at the end of the drive screw 95, or in the middle between the drive screw sections 96 and 97. Any such modifications will remain within the scope of the present invention. Similar to other retractable patio awnings known in the industry, this awning may be equipped with a wind sensor that will automatically retract the awning upon detection of strong wind.

The rigid awning of the present invention will also be suitable for shading windows, for which purpose it would be made with a lesser projection than one usually required for patio awnings. Using such awnings for windows would be especially useful on high-rise residential or office buildings where access to the building exterior is difficult and using fabric retractable awnings is not practical.

The invention claimed is:

1. A rigid retractable awning, said awning comprising:

a plurality of rigid panels comprising at least one bottom panel and at least one top panel, said panels being disposed in a tiered relationship with each other, each lower panel being slidably connected with its respective upper panel via a set of slides;

an awning operating mechanism comprising an upper arm and a lower arm, an upper drive screw and a lower drive screw, one end of said upper arm being connected via a first swivel joint with said bottom panel and the other end being connected via a second swivel joint with a first threaded nut engaged with said upper drive screw, one end of said lower arm being connected via a third swivel joint with said bottom panel and the other end being connected via a fourth swivel joint with a second threaded nut engaged with said lower drive screw, said nuts being slidably connected with a mounting bar, whereby said awning is extended by rotating said drive screws, which causes said nuts to travel along said drive screws causing said arms to push said bottom panel outwardly, and said awning is retracted by rotating said drive screws in the opposite direction.

2. The retractable awning according to claim 1, wherein said nuts are slidably connected with a mounting bar by means of at least one linear bearing.

3. The retractable awning according to claim 2, wherein said linear bearing is a rolling bearing.

* * * * *